US005771648A

United States Patent [19]

Miller et al.

[11] Patent Number: 5,771,648

[45] Date of Patent: Jun. 30, 1998

[54] FOAM FORM CONCRETE SYSTEM

[75] Inventors: Brian J. Miller, McHenry; David W. Turner, Cary, both of Ill.

[73] Assignee: Foam Form Systems, L.L.C., McHenry, Ill.

[21] Appl. No.: 474,541

[22] Filed: Jun. 7, 1995

Related U.S. Application Data

[63] Continuation of Ser. No. 238,968, May 5, 1994, abandoned, which is a continuation of Ser. No. 987,551, Dec. 8, 1992, abandoned, which is a continuation of Ser. No. 725,396, Jul. 1, 1991, abandoned, which is a continuation of Ser. No. 501,416, Mar. 28, 1990, abandoned, which is a continuation of Ser. No. 167,782, Mar. 4, 1988, abandoned.

[51] Int. Cl.[6] ..... E04C 1/00

[52] U.S. Cl. ..... 52/309.7; 52/309.12; 52/562; 52/426

[58] Field of Search ..... 52/309.11, 309.12, 52/426, 427, 428, 506

[56] References Cited

U.S. PATENT DOCUMENTS

| | | | |
|---|---|---|---|
| 1,439,650 | 12/1922 | Thomas | 52/563 |
| 1,692,167 | 11/1928 | Gates | 249/215 |
| 1,702,672 | 2/1929 | Toogood | 249/215 |
| 1,800,802 | 4/1931 | Miller | 249/216 |
| 2,095,714 | 10/1937 | Pinaud | 249/216 |
| 2,921,462 | 1/1960 | Wilson | 52/426 |
| 3,325,198 | 6/1967 | Cruse | 52/426 |
| 4,133,156 | 1/1979 | Unger | 52/426 |
| 4,516,372 | 5/1985 | Grutsch . | |
| 4,750,308 | 6/1988 | McKay | 52/426 |
| 4,773,199 | 9/1988 | Kohara . | |
| 4,864,792 | 9/1989 | Andre | 52/428 |
| 4,902,494 | 2/1990 | Miller et al. | 52/309.12 |
| 4,967,528 | 11/1990 | Doran | 52/309.12 |
| 4,972,646 | 11/1990 | Miller et al. | 52/293.1 |
| 5,140,794 | 8/1992 | Miller et al. | 52/309.12 |

FOREIGN PATENT DOCUMENTS

| | | | |
|---|---|---|---|
| 1271208 | 7/1961 | France | 52/426 |
| 1037105 | 8/1958 | Germany | 52/426 |
| 1037105 | 10/1958 | Germany . | |
| 1905341 | 8/1970 | Germany | 52/426 |
| 788762 | 1/1958 | United Kingdom | 249/44 |

*Primary Examiner*—Creighton Smith
*Attorney, Agent, or Firm*—Leydig, Voit & Mayer, Ltd

[57] ABSTRACT

A pair of EPS foam panels have laterally aligned holes arranged in a rectangular grid. Cross wires or rods extend through the holes. Longitudinally extending wires or rods are located against the interior surfaces of the walls and are welded to the cross rods. Retaining means on the ends of the cross rods are disposed against the exterior surfaces of the walls to provide a sandwich construction firmly to interconnect the walls and the rods.

30 Claims, 1 Drawing Sheet

FIG. 1
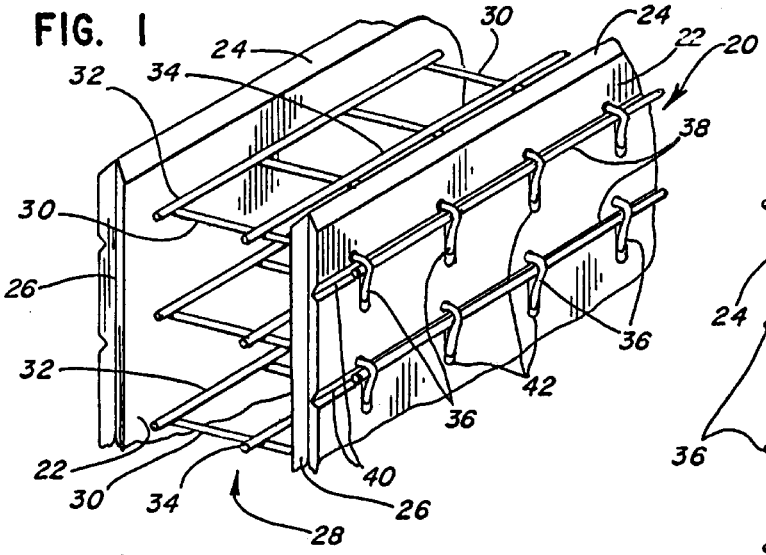
FIG. 2
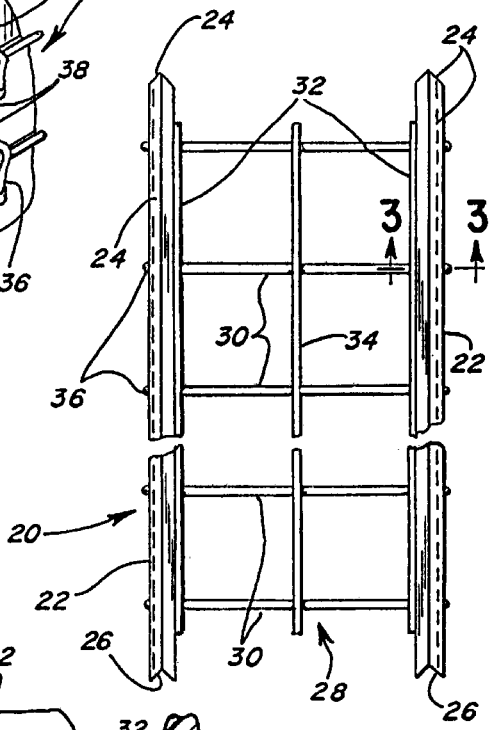
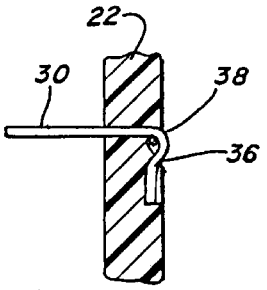
FIG. 3
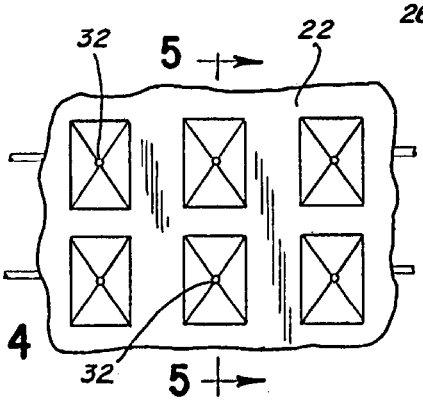
FIG. 4
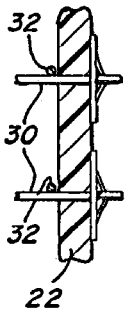
FIG. 5
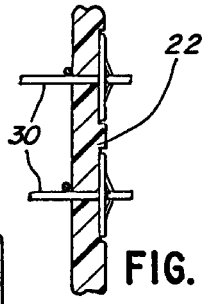
FIG. 6
FIG. 7
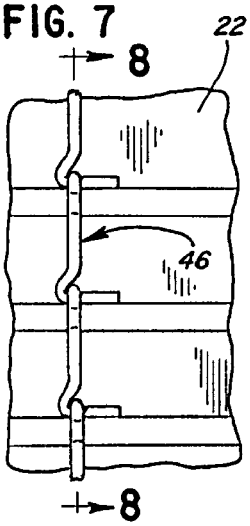
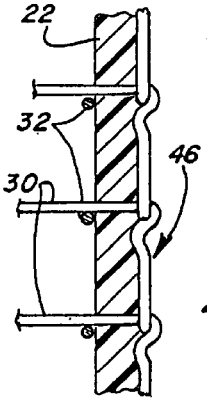
FIG. 8
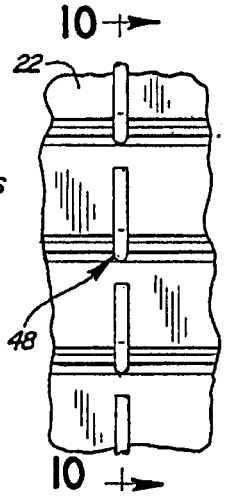
FIG. 9
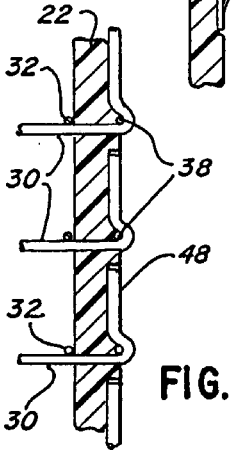
FIG. 10

FOAM FORM CONCRETE SYSTEM

This is a continuation of application(s) Ser. No. 08/238,968, filed on May 5, 1994, now abandoned, which is a continuation of Ser. No. 07/987,551, filed on Dec. 8, 1992, now abandoned, which is a continuation of Ser. No. 07/725,396, filed Jul. 1, 1991, now abandoned, which is a continuation of Ser. No. 07/501,416, filed Mar. 28, 1990, now abandoned, which is a continuation of Ser. No. 07/167,782, filed Mar. 14, 1988, now abandoned.

BACKGROUND OF THE INVENTION

The most common method of erecting concrete walls today involves first building forms of plywood and wood framing. Then, if reinforcement is needed, rebar or other kinds of metal reinforcement is installed in the space between the forms. In some installations, metal reinforcement is installed prior to building the forms. After the space is filled with concrete, the wooden forms are removed.

This type of procedure has proved to be expensive for a variety of reasons. The wood itself is expensive. Because of its weight, it is costly to transport the wood to the construction site. Qualified carpenters are needed to erect the wooden forms. Workers must come back after the concrete is poured to remove the forms. If insulation is required, the wood forms must be removed and then the insulation installed. When concrete is poured during cold weather, wood forms must be insulated by applying blankets to their sides and straw to the exposed surface of the concrete.

It has been proposed to construct the concrete forms of expanded polystyrene (EPS) foam. EPS foam is lightweight and, therefore, inexpensively transportable to the construction site. The forms provide insulation during pouring and can be left in place after the concrete is poured to eliminate the cost of removal and to provide insulation to the area defined by the concrete walls. A further advantage of foam forms is that it is easier to cut out openings for additional form work to create openings in the foundation.

However, foam-form concrete systems currently in the marketplace suffer a number of disadvantages. Tie members or cross pieces between the foam walls which maintain separation are too large. Stones in the concrete collect around these cross pieces and undesirably leave voids.

Another disadvantage of currently available systems is that they must be erected on the site in much the same manner as wood forms. The foam forms are erected and then the cross pieces added on the site. This adds to the expense of making concrete foundations.

Another disadvantage is that some of these systems do not provide metal reinforcement and/or they do not enable the addition of rebar reinforcement at the site.

SUMMARY OF THE INVENTION

It is, therefore, an object of the present invention to provide a foam-form concrete system which includes cross members of relatively small transverse cross section to minimize and perhaps eliminate the creation of voids in the region of these cross members.

Another object is to provide a foam-form concrete system in which the cross members are factory attached to the foam panels, to reduce the cost of erecting the forms at the site.

Another object is to provide a foam-form concrete system in which reinforcement rods are factory-built in and define space for rebar to be added at the site.

In summary, there is provided a unitary, concrete-form structure comprising spaced-apart first and second walls disposed substantially parallel to each other and being composed of foam, each of the walls having an interior surface and an exterior surface. Each wall has a multiplicity of holes therein. The holes in one of the walls are laterally aligned with corresponding holes in the other of the walls. A plurality of laterally extending first rods sometimes referred to as cross rods, are disposed between the walls and are substantially perpendicular to the interior surfaces thereof. Each rod spans the distance between the walls and has end portions passing through laterally aligned holes and being exposed on the exterior surfaces of both walls. A plurality of longitudinally extending second rods are disposed between the walls and attached to at least some of the first rods and being disposed against the interior surface of the first wall. A plurality of longitudinally extending third rods attached to at least some of the first rods are disposed between the walls and and are disposed against the interior surface of the second wall. The exposed end portions of the first rods are engaged by retaining means disposed against the exterior surfaces of the walls, whereby the first wall is firmly sandwiched between the second rods and the retaining means and the second wall is firmly sandwiched between the third rods and the retaining means.

The invention consists of certain novel features and a combination of parts hereinafter fully described, illustrated in the accompanying drawings,and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective, fragmentary view depicting one embodiment of the improved foam-form concrete system incorporating the features of the present invention;

FIG. 2 is an enlarged fragmentary view in plan of the foam-form concrete system of FIG. 1;

FIG. 3 is an enlarged fragmentary sectional view taken along the line 3—3 of FIG. 2;

FIG. 4 is a fragmentary elevational view of the exposed wall surface of a second embodiment of the improved system incorporating different retaining means;

FIG. 5 is a view in section taken along the line 5—5 of FIG. 4;

FIG. 6 is a view like FIG. 5 but illustrating a slight modification;

FIG. 7 is a fragmentary elevational view similar to FIG. 4, but showing a third embodiment of the improved system;

FIG. 8 is a view in section taken along the line 8—8 of FIG. 7;

FIG. 9 is a fragmentary elevational view similar to FIGS. 4 and 7, but showing a fourth embodiment of the improved system; and FIG. 10 is a view in vertical section taken along line 10—10 of FIG. 9.

DETAILED DESCRIPTION OF A PREFERRED EMBODIMENT

Turning now to FIGS. 1 and 2, there is depicted a foam-form concrete system 20 comprised of a pair of panels or walls 22 composed of expanded polystyrene (EPS) foam or its equivalent. EPS foam has the highly desirable features of being lightweight, yet rigid. The four edges of each of the walls 22 are provided with interfitting structure which, in the embodiment shown, is a tongue 24 on two of the edges and a mating groove 26 on the other two edges (one is shown).

The tongue-and-groove structure is shown to be V-shaped, but other formations can be used. The tongue-and-groove structure enables several foam-form concrete systems 20 to be interconnected to provide walls of any desired height or length. To create a form used in pouring a wall, several such systems 20 would be employed and they would interfit using the tongue-and-groove mechanism. Also, a rigidifying metal strip or channel would usually be affixed to the walls so that they will remain straight during pouring of the concrete. This is a standard approach used to connect several separate forms.

The foam-form concrete system 20 further comprises a wire grid or neck 28 disposed between the walls 22 and composed of a multiplicity of spaced first or cross rods 30. In FIG. 1, eight such rods are visible but it is to be understood that the number of rods would match the size of the walls 22. The two walls 22 have a multiplicity of holes and corresponding holes are in lateral alignment. The rods 30 are perpendicular to the walls 22 and as seen in FIG. 1 each rod has end portions which pass through laterally aligned holes.

The foam-form concrete system 20 further comprises a plurality of outer or second and third rods 32 which extend substantially parallel to each other and are disposed against the interior surfaces (inwardly facing surfaces) of the walls 22. In the fragmentary view of FIG. 1, three rows or layers are shown and each layer includes a pair of outer rods 32. The outer rods 32 disposed against the lefthand (as viewed in FIG. 1) wall 22 are visible. None of the outer rods against the righthand wall is visible in FIG. 1. In FIG. 2, both outer rods 32 in the top layer are visible. The two outer rods 32 for each layer are welded to all of the cross rods 30 in that layer thereby maintaining said rods in proper spaced relation. The outer rods 32 are shown to be on top of the cross rods 30, but that is not necessary.

Each layer also has a single inner or fourth rod 34 extending parallel to the outer rods 32 and being disposed midway between them. Each of the inner rods 34 is welded to all of the cross rods 30 in its associated layer. Again, the inner rod 34 need not be on top of the cross rods as depicted.

Each first rod 30 has the exposed end portions thereof bent-over to form retaining portions 36 which are disposed against the exterior surfaces of the walls 22. Thus, each of the walls 22 is firmly sandwiched between the outer rods 32 and the retaining portions 36. This sandwich configuration provides for a secure, relatively permanent interconnection of the wires or rods and the EPS walls. In the embodiment of FIGS. 1 and 2, there are provided longitudinally extending retaining rods 38 about which the retaining portions 36 are bent. In this particular embodiment, these rods reside in longitudinally extending grooves 40 formed in the outer surface of each of the walls 22. Each of a multiplicity of short grooves 42 in the outer surface of each wall 22, extending transversely to the grooves 40, provides a recess for the bent-over retaining portion 36 as is most clearly seen in FIG. 3.

The invention contemplates retaining means other than that depicted in FIGS. 1–3. For example, referring to FIGS. 4 and 5, a second embodiment of the improved system is shown wherein rectangular clips, having a central hole and being diagonally slitted and slightly folded, can be used in place of the retaining rods 38. The clips frictionally receive exposed unbent end portions of the cross rods 30. A recess in the outer surface of each wall 22 may be provided for each clip, as depicted in FIG. 6.

In a third embodiment of the improved system a retaining mechanism 46 is depicted in FIGS. 7 and 8, wherein the exposed end portion of the cross rods are bent to form hooks which hook onto the next cross rod adjacent its end. A fourth embodiment of the improved system is shown in FIGS. 9 and 10 which includes a retaining mechanism 48 depicted in FIGS. 9 and 10 wherein the end portions of the cross rods are bent upwardly. Other types of retaining means may be used as well.

In constructing the foam-form concrete system 20, it is preferable first to make holes in the walls 22, arranged in a rectangular pattern and then to insert the ends of rods 30 through the holes.

Although the rods 32 and 34 are depicted as being oriented horizontally, that need not be. Depending upon the particular needs of the installation, the system 20 can be rotated 90° such that the rods 32 and 34 extend vertically. In either event, reinforcing rods known as rebar can be installed parallel to the rods 32 and 34 and/or perpendicular to them at the site.

With this type of system, the walls are held firmly at a predetermined distance. When the concrete is poured, creating substantial, outwardly directed forces, the retention system prevents the walls from bowing or bulging. Also, because the cross rods 30 are preferably made of steel, they do not fracture in the presence of these forces.

In a preferred form of the invention, the rods 30, 32 and 34 are composed of ten-gauge wire meaning they have a diameter of 135 mils which is very small compared to the size of the aggregate in the concrete. As a result, when the concrete is poured, the aggregate readily flows around the cross rods 30 without any difficulty. No voids in the concrete are created because of the ease in which the aggregate flows around these obstructions.

In a specific embodiment, each of the walls 22 has a thickness of 2", and they are 6" apart or 10" apart. In a specific form, the cross rods 30 were 4" apart.

What has been described therefor is an improved concrete form system using EPS walls and a wire or rod mesh firmly interconnected to the walls. The mesh provides an interconnection and reinforcing structure for the walls which does not impede the flow of concrete.

What is claimed is:

1. A unitary forming system for a pourable hardenable material comprising first and second unitary, elongate wall panels of a lightweight foam plastic material arranged in spaced relation, each of said first and second wall panels having a periphery, an interior surface and an exterior surface with a plurality of through holes formed within a predetermined surface area spaced inwardly from the periphery of each wall panel, said holes in the first wall panel being laterally aligned with corresponding holes in the second wall panel, a plurality of laterally extending relatively spaced elongated first rods spanning the space between said wall panels, each rod having portions passing through corresponding laterally aligned holes in said first and second wall panels, said first rods extending substantially perpendicular to the wall panel interior surfaces, said portions including retaining portions extending beyond respective wall panel exterior surfaces, an elongate second rod angularly disposed relative to said first rods, spanning the spacing between said first rods and being attached to at least some of said first rods, said second rod engaging substantially throughout its length the interior surface of said first wall panel disposed between said first rods and providing support therefor, an elongate third rod spaced from said second rod, angularly disposed relative to said first rods and spanning the spacing between said first rods and being attached to at least some of said first rods, said third rod engaging substantially throughout its length the interior surface of said second wall panel disposed between said first rods and providing support therefor; said first, second and third rods being arranged relative to one another to form a unitary grid, the second and third rods of said grid being fixedly maintained in predetermined spaced relation by said first rods, said grid being adapted to be substantially embedded within hardenable material when the latter is poured between the first and second wall panels, elongate retaining means angularly disposed relative to said first rods and lockingly engaged with and extending between respective retaining portions of adjacent first rods, each retaining means engaging substantially throughout its length the exterior surface of the adjacent first or second wall panel disposed between said portions of adjacent first rods, whereby said first wall panel is fixedly sandwiched and supported between said second rod and said retaining means and said second wall panel is fixedly sandwiched and supported between said third rod and said retaining means;

said second rod and said retaining means being disposed relative to one another and supportingly engaging opposite surfaces of said first wall panel to effect reinforcement of said foam plastic material between said adjacent end portions, and said third rod and said retaining means being disposed relative to one another and supportingly engaging opposite surfaces of said second wall panel to effect reinforcement of said foam plastic material between adjacent end portions; said first and second wall panels being reinforced against outward distortion by said unitary grid and said elongate retaining means during pouring of hardenable material between the first and second wall panels whereby said portions of said first rods are retained in position in a hole in said panels against outward forces exerted by hardenable material when poured between said panels.

2. The unitary forming system for hardenable material of claim 1 including a plurality of grids disposed in spaced relationship and cooperating with said first and second wall panels.

3. The unitary forming system of claim 1 wherein said retaining means comprises a plurality of retaining rods, one of said retaining rods being secured to said adjacent end portions adjacent said first wall exterior surface and a second of said retaining rods being secured to said adjacent end portions adjacent said second wall exterior surface.

4. The unitary forming system of claim 3 wherein said one retaining rod is secured to all of the end portions of said grid disposed in said surface area and adjacent said first wall exterior surface and wherein said second retaining rod is secured to all of the end portions of said grid disposed in said surface area and adjacent said second wall exterior surface.

5. A unitary forming system for a pourable hardenable material comprising first and second unitary, elongate wall panels formed of sheets of a lightweight thermal insulative foam plastic material arranged in spaced relation, each of said first and second wall panels having a periphery, a substantially planar interior surface and a substantially planar exterior surface with a plurality of through holes formed within a predetermined surface area spaced inwardly from the periphery of said wall panel, said holes in the first wall panel being laterally aligned with corresponding holes in the second wall panel, a plurality of laterally extending relatively spaced elongate first rods spanning the spacing between said wall panels, each rod having portions passing through corresponding laterally aligned holes in said first and second wall panels, said first rods extending substantially perpendicular to the interior surfaces of said wall panels, said portions including retaining portions accessible adjacent said wall panel exterior surfaces, a plurality of relatively spaced elongate second rods angularly disposed relative to said first rods, spanning the spacing between said first rods and being fixedly attached to at least some of said first rods, said second rods being substantially parallel to and engaging substantially throughout their lengths the interior surface of said first wall panel disposed between said first rods and providing support therefor, a plurality of relatively spaced elongate third rods angularly disposed relative to said first rods, spanning the spacing between said first rods and fixedly attached to at least some of said first rods, said third rods being substantially parallel to and engaging substantially throughout their lengths the interior surface of said second wall panel disposed between said first rods and providing support therefor; said first, second and third rods being arranged relative to one another to form a unitary skeletal grid whereby said second and third rods are fixedly maintained in a predetermined spaced relation by said first rods, said grid being adapted to be substantially embedded within hardenable material when the latter is poured between the first and second wall panels, and a plurality of elongate retaining means substantially parallel to and disposed against the exterior surface of said wall panels, first predetermined retaining means being disposed substantially throughout their lengths against the first wall panel exterior surface and spanning the spacing between the retaining portions and lockingly engaging said retaining portions whereby said first wall panel is fixedly sandwiched and supported between said second rods and said first predetermined retaining means, and second predetermined retaining means disposed substantially throughout their lengths against said second wall panel exterior surface and spanning the spacing between the retaining portions of said first rods and lockingly engaging said retaining portions whereby said second wall panel is fixedly sandwiched and supported between said third rods and said second predetermined retaining means, whereby said portions of said first rods are retained in position in a hole in said panels against outward forces exerted by hardenable material when poured between said panels, said first and second predetermined retaining means being initially separate from the respective first rod accessible end portions.

6. The system of claim 5 wherein said wall panels are composed of an expanded plastic material.

7. The system of claim 6 wherein each of said wall panels includes means along peripheral edges thereof for interfitting with similar complemental means on peripheral edges of adjacent wall panels.

8. The system of claim 7 wherein said peripheral means is a tongue and groove structure.

9. The system of claim 8 further comprising a plurality of longitudinally extending fourth rods attached to at least some of said first rods and interposed between said second and third rods, said second, third and fourth rods being spaced in substantially parallel relation thereby maintaining a generally planar grid arrangement.

10. The system of claim 9 wherein said fourth rods are substantially equidistant from said second and third rods.

11. The system of claim 5 wherein said first rod retaining portions are shaped to accommodate and engage said retaining means, said retaining means comprising a rod.

12. The system of claim 11 wherein said retaining means engage each first rod retaining portion of a given grid.

13. The system of claim 12 wherein said retaining means are disposed generally parallel to said grid and distribute resulting outward forces substantially throughout said wall panels when hardenable material is poured between said walls.

14. The system of claim 13 wherein the exterior surface of each wall panel includes a plurality of grooves interconnecting adjacent wall holes and accommodating said retaining means.

15. The system of claim 11 wherein said first rod retaining portions include bent-over notch portions accommodating said retaining means.

16. The system of claim 15 wherein the exterior surfaces of said wall panels include a plurality of recesses accommodating said rod portions.

17. The system of claim 5 wherein said first rod portions include retaining portions and retaining means, said retaining portion comprising a first hooked-shaped portion formed by bending said first rod portion parallel to the outer surface of said wall panel, and said retaining means comprising a second hook-shaped portion formed by bending said first rod portion in a direction in order that said second hook-shaped portion maintains a parallel disposition to the outer surface of said wall panel but is substantially transverse to said retaining portion.

18. The system of claim 17 wherein said retaining means of said first rod end portion engages said retaining portion of said first rod end portion of an adjacent grid thereby serving to distribute the resulting outward forces from the poured hardenable material throughout said wall panels.

19. The system of claim 18 wherein each retaining portion includes a notch to accommodate the retaining means of said first rod portion of an adjacent grid.

20. The system of claim 17 wherein the retaining means includes a notch to accommodate said retaining portion of said first rod portion of an adjacent grid.

21. The system of claim 17 wherein said retaining portions include notches to accommodate said retaining means of said first rod portions of an adjacent grid, and said retaining means include notches to accommodate said retaining portions of said first rod portions of an adjacent grid.

22. A unitary forming system for a pourable hardenable material comprising first and second unitary, elongate wall panels of a lightweight foam plastic material arranged in spaced relation, each of said first and second wall panels having a periphery, an interior surface and an exterior surface with a plurality of through holes formed within a predetermined surface area spaced inwardly from the periphery of each wall panel, said holes in the first wall panel being laterally aligned with corresponding holes in the second wall panel, a plurality of laterally extending relatively spaced elongated first rods spanning the space between said wall panels, each rod having portions passing through corresponding laterally aligned holes in said first and second wall panels, said first rods extending substantially perpendicular to the wall panel interior surfaces, said portions including retaining portions extending beyond respective wall panel exterior surfaces, first retaining means angularly disposed relative to said first rods and attached to said first rods for engaging the interior surface of said first wall panel disposed between said first rods and providing support therefor, second retaining means spaced from said first retaining means and being attached to said first rods, said second retaining means engaging the interior surface of said second wall panel disposed between said first rods and providing support therefor, third retaining mean angularly disposed relative to said first rods and lockingly engaged with respective retaining portions of said first rods, said third retaining means engaging substantially throughout its length the exterior surface of the adjacent first or second wall panel disposed between said portions of adjacent first rods, whereby said first wall panel is fixedly sandwiched and supported between said first retaining means and said third retaining means and said second wall panel is fixedly sandwiched and supported between said second retaining means and said third retaining means;

said first retaining means and said third retaining means being disposed relative to one another and supportingly engaging opposite surfaces of said first wall panel to effect reinforcement of said foam plastic material between said portions of adjacent first rods, and said second retaining means and said third retaining means being disposed relative to one another and supportingly engaging opposite surfaces of said second wall panel to effect reinforcement of said foam plastic material between said portions of adjacent first rods; said first and second wall panels being reinforced against outward distortion by said first rods, said first retaining means, said second retaining means and said third retaining means during pouring of the hardenable material between the first and second wall panels whereby said portions of said first rods are retained in position in a hole in said panels against outward forces exerted by hardenable material when poured between said panels.

23. A forming system to receive pourable, hardenable material comprising at least one forming unit having a pair of foam plastic wall panels arranged in a predetermined upright spaced relation, each wall panel having exterior and interior surfaces, said interior surfaces being in opposed relation, and a skeletal grid assembly disposed between said wall panels for retaining same in said predetermined spaced relation while such hardenable material is being poured therebetween; said grid assembly including a plurality of elongate substantially rigid first means arranged in spaced relation and spanning the distance between the interior surfaces of said wall panels, each first means having portions thereof disposed within predetermined holes formed in said wall panels, a plurality of elongate second means disposed intermediate said wall panels and engaging the interior surfaces thereof, said second means being angularly disposed relative to said first means and affixed thereto; said second means extending between and maintaining said plurality of said first means in said spaced relation; retainer means adjacent the exterior surface of each wall panel and extending between the portions of adjacent first means, said retainer means and said second means coacting to secure the wall panels therebetween, the portions of said grid assembly disposed between said wall panel interior surfaces being adapted to be embedded in the poured hardenable material, and a retainer portion of said first means extending beyond said external surfaces and lockingly interconnecting a retainer means, one of said wall panels being sandwiched between said second means and said retainer means whereby said retainer means prevents said first means from being pulled through said wall panel by outward forces exerted by said poured material.

24. A forming system to receive pourable, hardenable material comprising at least one forming unit having a pair of wall panels of plastic foam construction arranged in a predetermined upright spaced relation, said wall panels having exterior and interior surfaces, said interior surfaces being in opposed relation, and a skeletal grid assembly disposed between said wall panels for retaining same in said predetermined spaced relation while such hardenable material may be poured therebetween; said grid assembly including a plurality of elongate substantially rigid first means arranged in spaced relation and spanning the distance between the interior surfaces of said wall panels, each first means having portions thereof disposed within and extending beyond predetermined holes formed in said wall panels, a plurality of elongate substantially rigid second means disposed intermediate said wall panels and engaging the interior surfaces thereof, said second means being angularly related to and extending between said first means and being affixed thereto; and retainer means adjacent the exterior surface of each wall panel, the portions of said grid assembly disposed between said wall panel interior surfaces being adapted to be embedded in the poured hardenable material, said retainer means and said second means coacting to secure the wall panels therebetween, the portions of said grid assembly disposed between said wall panel interior surfaces being adapted to be embedded in the poured hardenable material and a retainer portion of said first means extending beyond said external surfaces and lockingly interconnecting a retainer means, one of said wall panels being sandwiched between said second means and said retainer means whereby said retainer means prevents said first means from being pulled through said wall panel by outward forces exerted by said poured material.

25. The unitary forming system of claim 1 wherein said portions of said first rods have hook portions extending from said retaining portions and supporting said retaining means against said external surfaces.

26. The unitary forming system of claim 25 wherein said retaining means is integral with and extends between said retaining portion and said hook portion of said first rods.

27. The unitary forming system of claim 26 wherein said retaining means comprises an elongate rod extending between adjacent first rods, the hook means thereof supporting said retaining means against said external surface.

28. The forming system of claim 23 wherein said ends of said first means have hook means extending therefrom which support said retaining means against said external surfaces.

29. The forming system of claim 28 wherein said retaining means is integral with and extends between said retaining portion and said hook portion of said first means.

30. The forming system of claim 28 wherein said retaining means comprises an elongate rod extending between adjacent first means, the hook means thereof supporting said retaining means against said external surface.

* * * * *